US008910748B2

(12) United States Patent
Nielsen et al.

(10) Patent No.: US 8,910,748 B2
(45) Date of Patent: Dec. 16, 2014

(54) PANEL

(75) Inventors: Jesper Nielsen, København D. (DK); Henrik Holm, København K. (DK)

(73) Assignee: Soft Cells A/S, Ebeltoft (DK)

( * ) Notice: Subject to any disclaimer, the term of this patent is extended or adjusted under 35 U.S.C. 154(b) by 0 days.

(21) Appl. No.: 13/881,628

(22) PCT Filed: Oct. 24, 2011

(86) PCT No.: PCT/EP2011/068551

§ 371 (c)(1),
(2), (4) Date: May 17, 2013

(87) PCT Pub. No.: WO2012/055817

PCT Pub. Date: May 3, 2012

(65) Prior Publication Data

US 2013/0264145 A1 Oct. 10, 2013

(30) Foreign Application Priority Data

Oct. 25, 2010 (EP) ..... 10188674

(51) Int. Cl.

| | |
|---|---|
| ***E04B 1/84*** | (2006.01) |
| ***E04B 1/82*** | (2006.01) |
| ***E04B 1/90*** | (2006.01) |
| ***E04B 9/00*** | (2006.01) |
| ***E04B 9/04*** | (2006.01) |
| ***F24F 13/24*** | (2006.01) |

(52) U.S. Cl.

CPC ..... *E04B 1/8209* (2013.01); *E04B 1/90* (2013.01); *E04B 9/001* (2013.01); *E04B 9/0428* (2013.01); *E04B 9/0457* (2013.01); *E04B 9/0471* (2013.01); *E04B 9/0485* (2013.01); *F24F 13/24* (2013.01); *E04B 2001/8428* (2013.01); *E04B 2001/8452* (2013.01); *E04B 2009/0492* (2013.01)

USPC ..... 181/284; 181/292

(58) Field of Classification Search

USPC ..... 181/284, 288, 290, 291, 292, 293, 295; 52/144, 145

See application file for complete search history.

(56) References Cited

U.S. PATENT DOCUMENTS 1,726,500 A * 8/1929 Norris ..... 52/145
1,997,596 A * 4/1935 Paley ..... 52/145

(Continued)

FOREIGN PATENT DOCUMENTS

EP 0605784 7/1994

OTHER PUBLICATIONS

International Search Report for PCT/EP2011/068551 dated Jan. 13, 2012.

(Continued)

*Primary Examiner* — Jeremy Luks

(74) *Attorney, Agent, or Firm* — Marvin Petry; Stites & Harbison PLLC

(57) ABSTRACT

The present invention relates to panels that can be used to cover interior surfaces in buildings, for instance in auditoriums, open-plan offices etc., where the panels can be used in buildings with thermally activated building systems (TABS) in which balancing of acoustics and thermal comfort is a well-recognized challenge. According to a first embodiment of the invention there is provided a panel comprising one or more sound-absorbing elements (3) and sub-regions (7, 8, 9) that connect the front (11) of the panel with the rear (12) of the panel, and in which sub-regions (7, 8, 9) sound-absorbing elements (3) are not present, whereby said sub-regions (7, 8, 9) ensure thermal transmission through the panel. According to a second embodiment of the invention the panels comprise a substantially rigid frame (1) defining a region within the frame, where the region is provided with one or more sound-absorbing elements comprising a front face and a rear face, where the one or more sound-absorbing elements extend(s) over the entire region defined by the frame (1) and where said sub-regions (22) are provided through said sound-absorbing elements, such that the sub-regions (22) connect said front face and rear face of the one or more sound-absorbing elements.

9 Claims, 6 Drawing Sheets

(56) References Cited

U.S. PATENT DOCUMENTS

| | | | | | |
|---|---|---|---|---|---|
| 2,112,631 | A | * | 3/1938 | MacDonald | 52/144 |
| 2,271,871 | A | * | 2/1942 | Newport et al. | 52/145 |
| 2,291,220 | A | * | 7/1942 | Germonprez | 454/296 |
| 2,486,563 | A | * | 11/1949 | Jorgensen | 181/284 |
| 3,074,339 | A | * | 1/1963 | Pennati | 454/296 |
| 3,159,090 | A | * | 12/1964 | Schutt | 454/270 |
| 3,483,947 | A | * | 12/1969 | Sulewsky | 181/290 |
| 4,330,046 | A | | 5/1982 | Lerner et al. | |
| 4,611,444 | A | | 9/1986 | Nassof | |
| 4,667,768 | A | * | 5/1987 | Wirt | 181/286 |
| 4,706,422 | A | * | 11/1987 | Ashton | 52/145 |
| 6,457,554 | B1 | * | 10/2002 | Wang | 181/282 |
| 6,817,442 | B2 | * | 11/2004 | Van Sleet et al. | 181/293 |
| 7,954,293 | B2 | | 6/2011 | Nielsen | |
| 2003/0136073 | A1 | | 7/2003 | Arx et al. | |
| 2006/0219477 | A1 | | 10/2006 | Ayle | |
| 2007/0186493 | A1 | * | 8/2007 | Baig | 52/144 |
| 2007/0235253 | A1 | * | 10/2007 | Hiraku et al. | 181/293 |
| 2008/0289901 | A1 | * | 11/2008 | Coury | 181/286 |
| 2009/0178882 | A1 | | 7/2009 | Johnson | |

OTHER PUBLICATIONS

Written Opinion of the International Searching Authority Report for PCT/EP2011/068551 dated Jan. 13, 2012.

International Preliminary Report on Patentability for PCT/EP2011/068551 dated Feb. 5, 2013.

* cited by examiner

PANEL

TECHNICAL FIELD

The present invention relates generally to panels that can be used to cover interior surfaces in buildings, for instance in auditoriums, open-plan offices etc. and more specifically to such panels for use in buildings with thermally activated building systems (TABS) in which balancing acoustics and thermal comfort is a well-recognised challenge.

BACKGROUND OF THE INVENTION

In such fields as architecture and interior design them is often a need for panels for covering of boundaries of a room, such as the ceiling, the walls or partitions placed within the room. Such panels can serve purely aesthetic purposes but can also be used to actively alter a room's characteristics, for instance relating to acoustic and thermal properties a the room.

Panels used to determine the acoustic properties of a room often comprise a frame structure supporting a plate of a sound-absorbing material such as mineral wool, gypsum or a thin wood membrane. Although such panels can offer quite excellent solutions relating to acoustic regulation of rooms, the thermal properties of such panels, such as their thermal transparency, are seldom optimal and may in fact be very far from optimal. It is a problem with known panels simultaneously to optimise acoustic properties and thermal properties and hence to use the panels in an attempt to optimise overall comfort of a room.

Especially in buildings with thermally activated building systems (TABS), balancing acoustics and thermal comfort is a well-recognised challenge.

SUMMARY OF THE INVENTION

On the above background, it is an object of the present invention to provide panels which to a high degree optimise both the thermal properties and the acoustical properties of the panels. The panels of the present invention preferably combine a sustainable design with a unique aesthetic and an excellent functional performance, thereby offering a high degree of control of acoustics and thermal comfort. Panels according to the invention features innovative "Thermal Transparency" technology, and can advantageously be used in combination with thermally activated building systems (TABS), while still ensuring strong acoustic performance.

The panels according to the invention offer flexible solutions to diverse interior requirements. They are quick to install, they can easily be taken down, reassembled and reupholstered to meet changing requirements. The panels according to the invention can be provided with a fabric covering the front face of the panel, and according to an embodiment of the invention this fabric can easily be changed, as often as needed, to reflect updated usage or design needs.

According to a preferred embodiment of the invention, the panels comprise a frame, for instance made of aluminum, with a concealed tensioning mechanism which keeps the surface of the fabric perfectly stretched. As a result, the panels according to this preferred embodiment are not affected by changes in humidity or temperature and remain looking good for many years.

The panels according to the invention can be used at least to regulate the following key environmental aspects of a room:

Acoustics:

The panels according to the invention can be tailored to meet the full spectrum of acoustic challenges, whatever the size and function of the room in question. As a result, the panels of the invention are particularly relevant to today's architecture, which often features open-plan rooms that are critical with respect to acoustic noise problems.

Thermal Comfort:

In buildings with thermally activated building systems (TABS), balancing acoustics and thermal comfort is a well-recognised challenge. The panels according to the invention have been designed to assist in controlling the interior temperature of such premises.

The panels according to the invention allow for the transmission of thermal radiation without any significant reduction of acoustic performance. As a result, the panels according to the invention can optimise comfort and significantly contribute to reducing a building's energy consumption.

According to the invention, the above and other advantageous effects are obtained with a panel comprising one or more sound-absorbing elements and sub-regions that connect the front of the panel with the rear of the panel, and in which sub-regions, sound-absorbing elements are not present. These sub-regions thereby ensure a high degree of thermal transmission through the panel.

The panel according to the invention thus comprises one or more sound-absorbing elements and sub-regions that connect the front of the panel with the rear of the panel, and in which sub-regions sound-absorbing elements are not present, where the sub-regions form channels through the panel that connect the front of the panel with the rear of the panel, whereby the sub-regions ensure thermal transmission through the panel.

The sub-regions that ensure the required thermal transmission through the panel can according to a first class of embodiments of the invention be entirely open, i.e. providing fluid connection between front and rear surfaces of the panel or they can be filled with a material that has a high thermal conductivity, thereby blocking fluid connection through the sub-regions between front and rear surfaces of the panel, but still ensuring a required thermal transmission through the sub-regions.

According to an embodiment of the panel according to the invention, the panel comprises a substantially rigid frame defining a region comprising said sound-absorbing elements, where said region is provided with one or more sound-absorbing elements comprising a front face, a rear face and a plurality of side faces, arranged in said frame in such a manner that at least some of said side faces are exposed to a sound field in surroundings, in which said panel is placed. The sound-absorbing elements can be substantially box-shaped, but other shapes could also be used without departing from the scope of the invention.

According to preferred embodiments of the invention, sound absorption is not only provided by the sound field coming in contact with the front surface of the sound-absorbing elements but also with side surfaces of these elements, thereby increasing the effective absorption area of the individual sound-absorbing elements and thereby compensating for the reduced front area of the sound-absorbing elements compared with a panel, wherein the entire front surface consists of a sound-absorbing material. The overall sound absorption of a panel according to the invention is thus affected not only by the front area of the panel (or both the front and rear area of the panel if it is exposed to a sound field on both front and rear side of the panel) but also by the total side area of the sound-absorbing elements and hence by the thickness of the panel.

According to an embodiment of the panel according to the invention, the dimensions of said sound-absorbing elements are chosen according to the lowest frequency at which substantial sound absorption shall take place.

According to an embodiment of the panel according to the invention, the frame is furthermore provided with a sheet of flexible material, for instance a fabric, suspended over the front of the region defined by the frame. The frame is preferably provided with means for releasable attachment of the flexible material to the frame and preferably these attachment means are formed for tensioning the flexible material over the region defined by the frame, such that the flexible material always remains tensioned regardless of for instance changes in temperature and humidity of the surroundings and of aging effects of the flexible material itself.

According to a further embodiment of the invention, the panel according to the invention is provided with a sheet of flexible material, for instance fabric, suspended over both the front and the rear of the region defined by the frame.

According to a further embodiment of the panel according to the invention, the sub-regions are provided through said sound-absorbing elements. This embodiment of the invention comprises a substantially rigid frame defining a region within the frame, where the region is provided with one or more sound-absorbing elements comprising a front face and a rear face, where the one or more sound-absorbing elements extend(s) over the entire region defined by the frame and where said sub-regions are provided through said sound-absorbing elements, such that the sub-regions connect said front face and rear face of the one or more sound-absorbing elements.

The sub-regions may provide fluid connection between said front face and rear of the one or more sound-absorbing elements.

The present invention furthermore relates to a method for optimising both the thermal properties and the acoustical properties of panels for offering flexible solutions to diverse interior requirements, such as in connection with thermally activated building systems (TABS), while still ensuring a required sound-absorption function of the panels, the method comprising:

(i) the provision of one or more panels comprising one or more sound-absorbing elements and sub-regions that connect a front face (11) of the panel with a rear face of the panel, and in which sub-regions sound-absorbing elements are not present, the sub-regions forming channels through the panel that provide thermal transmission between the front of the panel and the rear of the panel, whereby said sub-regions ensure thermal transmission through the panel;

(ii) determining the physical characteristics of said sub-regions such that required thermal transmission through the panel is substantially ensured;

(iii) determining the physical characteristics of the sound-absorbing elements such that the required sound absorption characteristics are substantially ensured.

BRIEF DESCRIPTION OF THE DRAWINGS

The invention will be better understood by reading the following detailed description of embodiments of the invention and the result of acoustical tests showing the effect of the invention in conjunction with the figures, where:

FIG. 5(*b*) shows a cross sectional view through the panel according to the embodiment of the invention shown in FIG. 5(*a*).

DETAILED DESCRIPTION OF THE INVENTION

Figure 1:
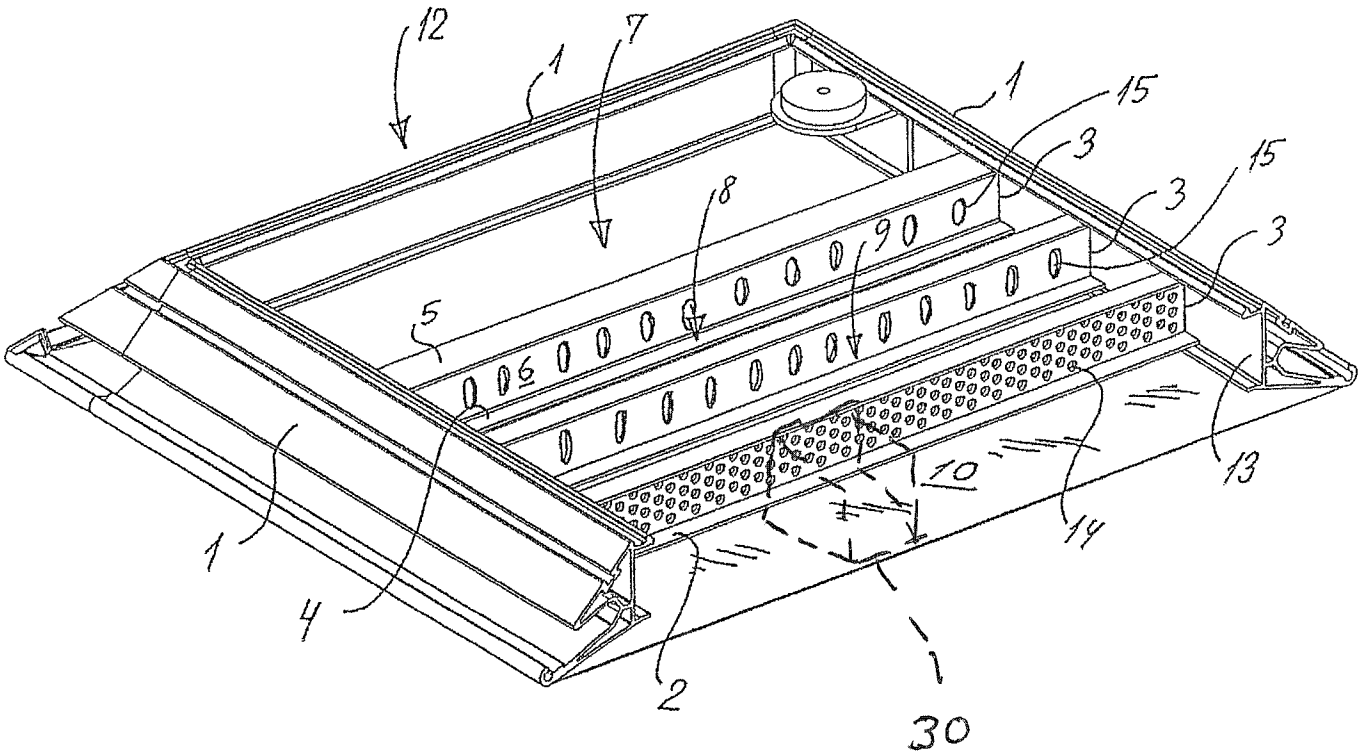
FIG. 1 shows a schematic perspective view of a first embodiment of a panel according to the invention.

Referring to FIG. 1 there is shown a schematic perspective view of an embodiment of a panel according to the invention, where the panel comprises a substantially rigid frame 1 defining a central region of the panel that connects the front face 11 of the panel with the rear face 12 of the panel, the panel being seen from the rear in FIG. 1.

The central region is provided with two sound receptacle regions 7 and 9 for absorbing elements (not shown), which sound-absorbing elements comprise a front face, a rear face and a plurality of side faces, arranged in said frame in such a manner that at least some of said side faces are exposed to a sound field in surroundings, in which said panel is placed. In order to attach the sound-absorbing elements in the frame, the frame is provided with transversal brackets 3, in the shown embodiment comprising a central portion 6 and top and bottom portions 4 and 5. Together with the frame, this structure forms receptacles for accommodating the sound-absorbing elements. In order to provide access of the sound field to the side faces of the sound-absorbing elements, the central portions 6 of the brackets are provided with apertures through the central portion. This is exemplified in FIG. 1 by a pattern of circular apertures 14, but as these apertures could have other shapes, corresponding apertures 15 are shown in the adjacent bracket in the form of elongated slits. A mesh of sufficient strength and/or for that matter a fabric could alternatively be used, provided it would keep the sound-absorbing elements in place and provide sound access to the side faces of the absorbers.

The central region comprises sub-regions 8 forming channels through the panel that connect the front 11 of the panel with the rear 12 of the panel, and in which sub-regions 8, sound-absorbing elements are not present. These sub-regions or channels through the panel facilitates thermal transmission through the panel and thus provides the "thermal transparency" that is a characteristic feature of the invention.

In the embodiment shown in figure la, the sound-absorbing elements are substantially box-shaped, but it is understood that other shapes of sound-absorbing elements could also be used in a panel according to the invention.

According to an embodiment of the invention, the dimensions of the sound-absorbing elements can be chosen according to the lowest frequency at which substantial sound absorption shall take place.

According to an embodiment of the invention, the frame is furthermore provided with a sheet of flexible material 10, for instance a fabric, suspended over the front 11 of the region defined by the frame.

Below follow the results of some initial experiments carried out in order to demonstrate the principles of the invention. All experiments were carried out with 40 mm batts obtainable from the company Ecophon.

(1) Experimental Results with Mineral Wool Directly on the Floor

The experimental results are summarised in TABLE 1 below:

TABLE 1

Experimental results with mineral wool directly on the floor

| Frequency Tom rums maling | Alpha Value 25% 12.5 cm Ecophon wall | 25% 25 cm Ecophon wall | 25% 50 cm Ecophon wall | 25% 100 cm Ecophon wall | 50% 12.5 cm Ecophon wall | 50% 25 cm Ecophon wall | 50% 50 cm Ecophon wall |
|---|---|---|---|---|---|---|---|
| 125 | 0.04 | 0.06 | 0.09 | 0.11 | 0.13 | 0.13 | 0.15 |
| 250 | 0.17 | 0.19 | 0.22 | 0.21 | 0.32 | 0.36 | 0.40 |
| 500 | 0.46 | 0.46 | 0.41 | 0.37 | 0.73 | 0.76 | 0.75 |
| 1000 | 0.67 | 0.53 | 0.43 | 0.37 | 0.94 | 0.90 | 0.79 |
| 2000 | 0.62 | 0.48 | 0.40 | 0.33 | 0.92 | 0.83 | 0.73 |
| 4000 | 0.56 | 0.44 | 0.37 | 0.34 | 0.81 | 0.72 | 0.67 |
| Mean | 0.42 | 0.36 | 0.32 | 0.29 | 0.64 | 0.62 | 0.58 |
| Mean 0.5-4K | 0.58 | 0.48 | 0.41 | 0.35 | 0.85 | 0.81 | 0.73 |

| Frequency Tom rums maling | Alpha Value 50% 100 cm Ecophon wall | 75% 37.5 cm Ecophon wall | 75% 75 cm Ecophon wall | 75% 150 cm Ecophon wall | 100% 250 cm Ecophon wall |
|---|---|---|---|---|---|
| 125 | 0.14 | 0.15 | 0.17 | 0.18 | 0.18 |
| 250 | 0.41 | 0.54 | 0.55 | 0.57 | 0.71 |
| 500 | 0.67 | 0.97 | 0.93 | 0.93 | 1.11 |
| 1000 | 0.69 | 1.05 | 1.02 | 0.94 | 1.16 |
| 2000 | 0.66 | 0.98 | 0.93 | 0.88 | 1.07 |
| 4000 | 0.60 | 0.90 | 0.85 | 0.81 | 0.95 |
| Mean | 0.53 | 0.76 | 0.74 | 0.72 | 0.86 |
| Mean 0.5-4K | 0.66 | 0.97 | 0.93 | 0.89 | 1.07 |

From the above experimental results it appears that there is a general tendency of the absorption increasing with increasing amount of sound-absorbing material. However, more specifically it appears that with 25% coverage with "small absorbers" ("small slats") almost as much absorption is obtained as with twice the amount of absorbing material (50%) present in the form of larger absorbers in the frequency range 1 to 4 kHz. This effect is largely the result of the presence of an increased number of side faces (edge portions) of the absorbers 3, which side faces largely increases the sound-absorbing surface area of the absorbers. With 75% coverage, approximately 35% higher absorption is obtained even in the largest absorbers (largest slats).

At 1000 Hz it appears that for each of the degrees of perforation (percentage coverage) (25%, 50% and 75%, respectively), larger absorption is obtained, the smaller the size of the absorbers (slats). This is, however, not the case in the 250 Hz and even less at 125 Hz frequency bands. The reason for this is that the edge portions (side faces) of the absorbers that greatly increase the absorption area in these frequency regions are too small compared with the wavelength of sound at these frequencies to have any appreciable sound absorption effect. In fact, the sound absorption is greater for the large absorbers (slats) at the low frequencies, as the dimensions of the absorbers at these low frequencies become comparable to the wavelength of sound. This fact is emphasised by the relatively small difference in sound absorption between many/few absorbers (slats) at a percent age coverage of 75%—the effect is only 10 to 15% in this case.

The overall conclusion is that it is recommendable to design the panels in such a manner that the effect of the side faces (edge portions) of the absorbers (slats) is utilised in order to obtain large sound absorption and still have the required "thermal transparency" of the panels as described previously.

Figure 2:
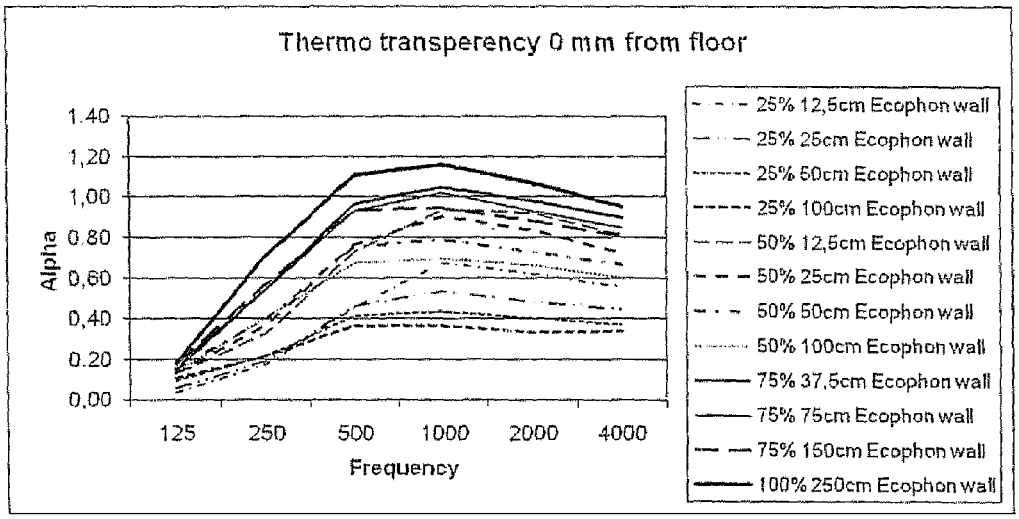
FIG. 2 shows a plot of all test results with absorbers placed directly on the floor ("0 mm")

In FIG. 2 there is shown a plot of all of the above test results with absorbers placed directly on the floor ("0 mm").

Figure 3:
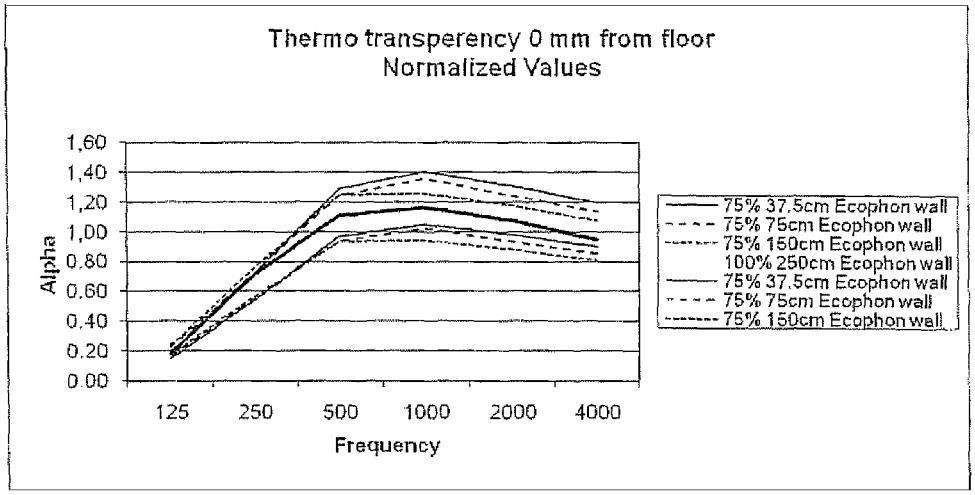
FIG. 3 shows sound absorption curves for 75% coverage (three lower lines) and the normalised values, absorption per unit area, i.e. how much the configuration would absorb in the hypothetical case of 100% coverage.

In FIG. 3 there is shown sound absorption curves for 75% coverage (three lower lines) and the normalised values (the three upper lines), i.e. absorption per unit area, i.e. how much the configuration would absorb in the hypothetical case of 100% coverage. As the three upper lines in fact lie above the line indicating measured values at 100% coverage, it is shown to be more effective to use absorbers (slats) than an absorber covering the whole area, because the side faces (edge portions) of the absorbers are exposed to the sound field.

(2) Experimental Results with Mineral Wool 100 mm Above the Floor

The experimental results are summarised in TABLE 2 below:

TABLE 2

Experimental results with mineral wool 100 mm above the floor

| Frequency Tom rums maling | 0 | 25% 25 cm Ecophon wall | 25% 50 cm Ecophon wall | 25% 100 cm Ecophon wall | 50% 12.5 cm Ecophon wall | 50% 25 cm Ecophon wall | 50% 50 cm Ecophon wall | 50% 100 cm Ecophon wall | 75% 37.5 cm Ecophon wall | 75% 75 cm Ecophon wall | 75% 150 cm Ecophon wall | 100% 250 cm Ecophon wall |
|---|---|---|---|---|---|---|---|---|---|---|---|---|
| | Alpha Value | | | | | | | | | | | |
| 125 | 0.05 | 0.05 | 0.06 | 0.09 | 0.07 | 0.07 | 0.13 | 0.21 | 0.19 | 0.23 | 0.32 | 0.52 |
| 250 | 0.19 | 0.26 | 0.31 | 0.34 | 0.35 | 0.40 | 0.53 | 0.55 | 0.83 | 0.84 | 0.82 | 1.14 |
| 500 | 0.48 | 0.51 | 0.48 | 0.41 | 0.77 | 0.88 | 0.81 | 0.79 | 1.05 | 1.06 | 1.02 | 1.14 |
| 1000 | 0.55 | 0.50 | 0.46 | 0.39 | 0.83 | 0.79 | 0.74 | 0.68 | 0.94 | 0.92 | 0.86 | 1.01 |
| 2000 | 0.61 | 0.51 | 0.43 | 0.38 | 0.90 | 0.82 | 0.75 | 0.68 | 0.96 | 0.92 | 0.88 | 0.99 |
| 4000 | 0.61 | 0.53 | 0.44 | 0.37 | 0.83 | 0.78 | 0.74 | 0.66 | 0.89 | 0.87 | 0.83 | 0.93 |
| Mean | 0.41 | 0.39 | 0.36 | 0.33 | 0.62 | 0.63 | 0.62 | 0.59 | 0.81 | 0.81 | 0.79 | 0.96 |
| Mean 0.5-4K | 0.56 | 0.51 | 0.45 | 0.39 | 0.83 | 0.82 | 0.76 | 0.70 | 0.96 | 0.94 | 0.90 | 1.02 |

The same tendencies as for zero cm elevation above the floor as presented above appear from the results shown in TABLE 2.

(3) Summary of Results Shown in TABLE 1 and TABLE 2 Above

A summary of mean values of sound absorption coefficients is given below in TABLE 3:

TABLE 3

Mean values for sound absorption coefficients for 0 and 100 mm elevation of absorbers (slats) above the floor.

| | | | | | | | | | | | | |
|---|---|---|---|---|---|---|---|---|---|---|---|---|
| Mean_10 cm 0.5-4K | 0.40 | 0.36 | 0.31 | 0.27 | 0.57 | 0.56 | 0.53 | 0.49 | 0.66 | 0.66 | 0.63 | 0.73 |
| Mean_0 cm 0.5-4K | 0.24 | 0.23 | 0.20 | 0.18 | 0.36 | 0.36 | 0.34 | 0.32 | 0.44 | 0.44 | 0.42 | 0.49 |
| % gevinst for 10 cm | 63 | 59 | 54 | 52 | 57 | 54 | 54 | 51 | 50 | 50 | 49 | 47 |

In the lower row of the table is stated how many percentage the absorption of the mineral wool is increased, when the absorber is elevated 100 mm above floor level. A considerable percentage increase (approximately 50%) is observed, even with this type of batt, which is not designed specifically for this purpose.

Figure 4:
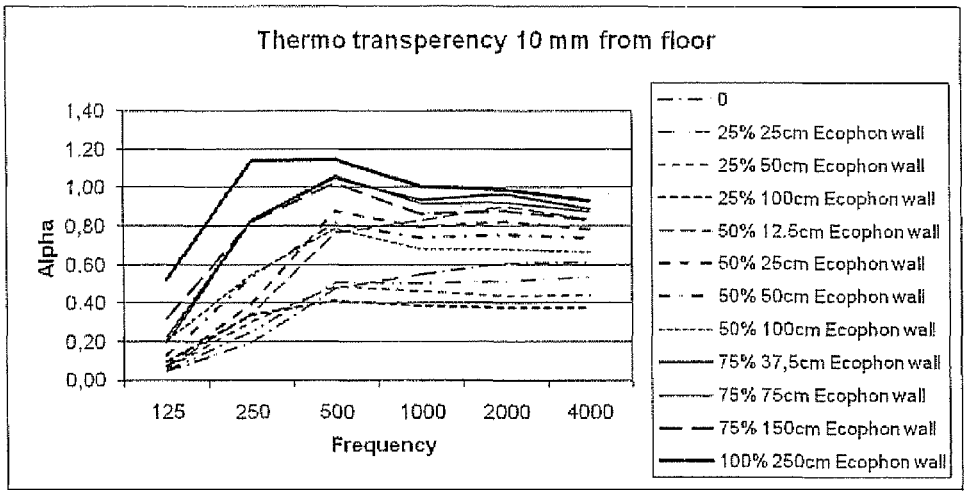
FIG. 4 shows results corresponding to those of FIG. 1, but with the absorbers placed 10 mm from the floor.

Referring to FIGS. 2, 3 and 4, these figures show plots corresponding to the experimental results given in the above tables.

The overall conclusion is thus that the use of the acoustic effect of the side faces (edge portions) of the absorbers (slats) is advantageous in such panels and can be used for providing panels with the desired combination of acoustic absorption and thermal transparency.

Furthermore, a considerable percentage increase of sound absorption (approximately 50%) is obtained with only 100 mm distance between the panel and the wall (even with the type of batts used in the present investigation that may not be optimal for this purpose).

Figure 5A:
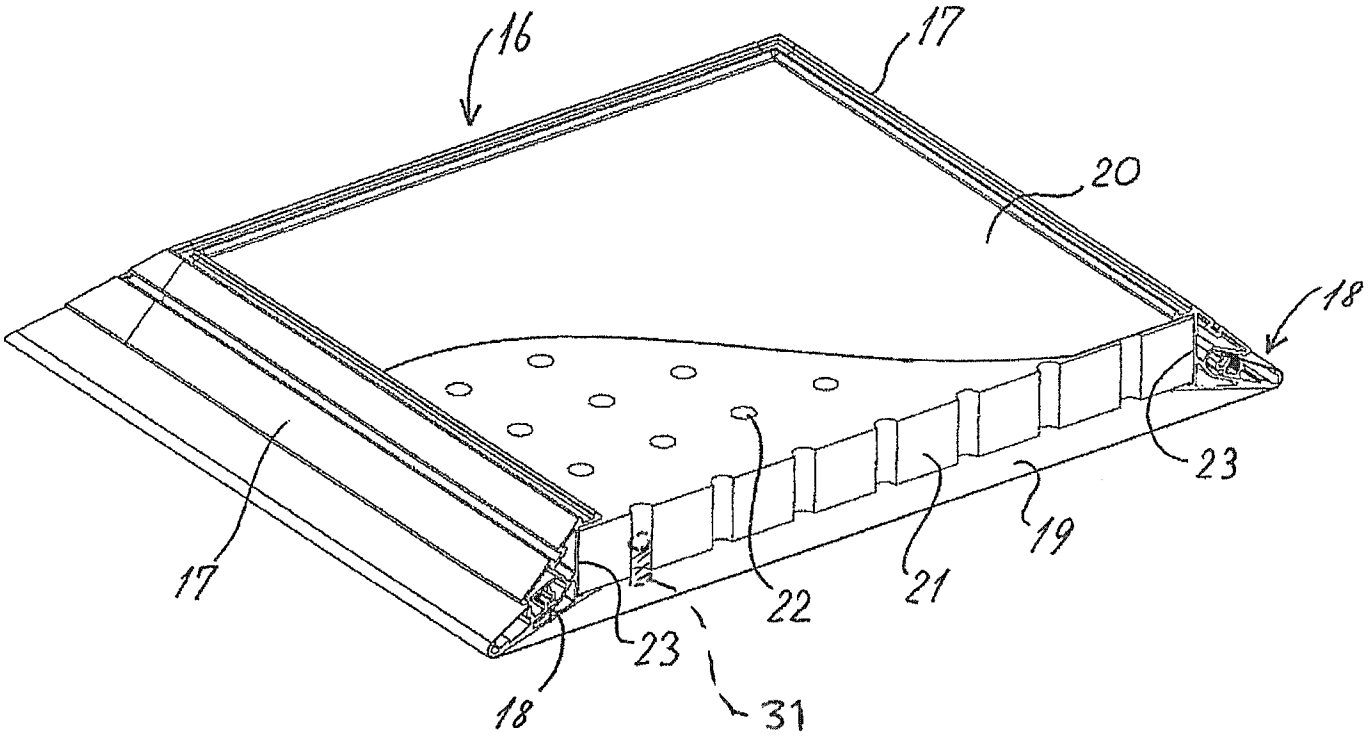
FIG. 5(*a*) shows a schematic perspective view of the second embodiment of a panel according to the invention showing a cross section through the panel for illustrating the interior structure of the panel.
Figure 5B:
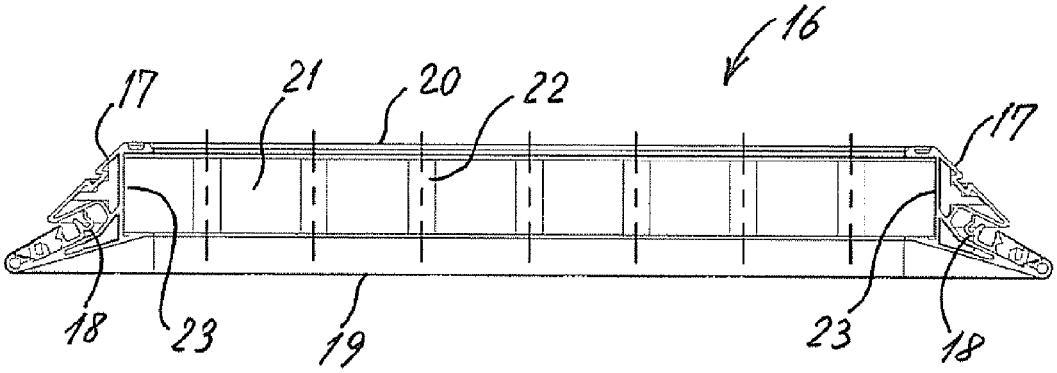

A second embodiment of a panel according to the invention is shown in FIGS. 5(*a*) and 5(*b*)

With reference to FIG. 5(*a*) there is shown a schematic perspective view of the second embodiment showing a cross section through the panel for more clearly illustrating the internal structure of the panel. The panel, generally designated by reference numeral 16, comprises a substantially rigid frame 17, along the edge portions of which there is provided self-tensioning means designated by reference numeral 18 used for keeping a sheet of flexible material, such as a fabric 19, extended over the front face of the panel. The self tensioning means shown in FIGS. 5(*a*) and 5(*b*) are of the type shown and described in detail in the applicant's prior international patent application WO 2005/073482 A2, but it is understood that also other types of self-tensioning means could be used without thereby departing from the scope of the invention as defined by the claims.

Optionally, the rear face of the panel could also be provided with a sheet of flexible material 20, which sheet could be attached to the frame 17, possibly by use of self-tensioning means as described above or otherwise attached to the respective portions of the frame 17.

Along inner portions of the frame there are provided recessed regions 23 forming attachment means for a sound-absorbing body 21 that, when mounted within the frame 17, can fill the entire internal region defined by the frame 17, or optionally may only fill a sub-region defined by the frame. In the embodiment shown in FIGS. 5(*a*) and 5(*b*), the sound-absorbing body 21 fills the entire region defined by the frame.

In order to ensure a required thermal transmission through the panel, the sound-absorbing body 21 is in the shown embodiment provided with a plurality of cylindrical through channels 22 forming a regular pattern throughout the face of the body 21 and providing fluid connection between front and rear surfaces of the sound-absorbing body 21. Numerous alternative shapes and dimensions of such channels extending through the body 21 from front to rear face hereof would also be possible without thereby departing from the scope of the present invention. The channels may furthermore not necessarily form a regular pattern as the one shown in FIG. 5(*a*).

With reference to FIG. 5(*b*) there is shown a cross sectional view through the panel according to the embodiment of the invention shown in FIG. 5(*a*).

The sub-regions or channels can be filled with a material that has a high thermal conductivity, thereby blocking fluid connection through the sub-regions or channels between the front and rear surfaces of that panel, while still insuring a required thermal transmission though the sub-regions or channels, as shown diagrammatically at 30 in FIG. 1 and at 31 in FIG. 5(*a*).

An advantageous acoustical effect can be obtained with the second embodiment of the invention. Thus, the dimensions and/or the mass per unit area of the sound-absorbing body 21 can be chosen such that the sound-absorbing body 21 will not only provide sound absorption caused by energy loss in the porous structure of the sound-absorbing material itself but also caused by sound field induced vibration of the body 21 as a whole, i.e. the sound-absorbing body 21 can according to the invention by proper dimensioning and choice of material function as the combination of a membrane or panel absorber and a porous sound absorber. As the porous absorber will be particularly effective at higher frequencies, whereas the membrane or panel absorber can be designed to be particularly effective at lower frequencies, the combined absorber according to the invention can be used for increasing the overall absorptive bandwidth of the panel according to the invention.

The invention claimed is:

1. A panel comprising:

a front and a rear, at least one sound absorbing element, at least one sub-region that extends from the front of the panel to the rear of the panel, the sub region or sub regions being free of sound absorbing elements to provide thermal transmission between the front of the panel and the rear of the panel, the panel comprising brackets which provide a receptacle between them and said sound absorbing element located in said receptacle, at least one bracket including apertures therethough which provide direct access from a sub-region to a side face of the sound absorbing material in the receptacle.

2. A panel according to claim 1, wherein the panel comprises a frame located at its periphery, and the brackets extending across the frame from one side of the panel to an opposite side of the panel.

3. A panel according to claim 1, wherein said sub-regions provide fluid connection between said front and rear of the panel.

4. A panel according to claim 1, wherein said sub-regions are provided with a material with high thermal conductivity which blocks fluid communication between the front and rear of the panel.

5. A panel according to claim 1, wherein the panel comprises a substantially rigid frame defining said receptacle within the frame, which is provided with one or more sound-absorbing elements comprising a front face, a rear face and a plurality of side faces, arranged in said receptacle in such a manner that at least some of said side faces are exposed to a sound field in the surroundings, in which said panel is placed.

6. A panel according to claim 1, wherein said sound-absorbing elements are substantially box-shaped.

7. A panel according to claim 1, wherein the dimensions of said sound-absorbing elements are chosen according to the lowest frequency at which substantial sound absorption shall take place.

8. A panel according to claim 2, wherein said frame is furthermore provided with a sheet of flexible material suspended over the front of the frame.

9. A panel according to claim 1, wherein said apertures are in the form of a mesh or a fabric.

* * * * *